United States Patent [19]

Miner

[11] Patent Number: 4,936,713

[45] Date of Patent: Jun. 26, 1990

[54] EARTH RETAINING SYSTEM

[76] Inventor: Thomas M. Miner, P.O. Box 59, Kingsville, Md. 21087

[21] Appl. No.: 219,559

[22] Filed: Jul. 14, 1988

[51] Int. Cl.[5] ..... E02D 29/02

[52] U.S. Cl. ..... 405/286; 405/273; 52/169.4

[58] Field of Search ..... 405/258, 262, 272, 273, 405/284–287; 52/102, 169.1, 169.4; 404/6

[56] References Cited

U.S. PATENT DOCUMENTS

| | | | |
|---|---|---|---|
| 654,683 | 7/1900 | Shaler | 405/284 X |
| 837,962 | 12/1906 | Rice | 52/169.1 X |
| 3,195,312 | 7/1965 | Rumsey | 52/169.1 X |
| 4,324,508 | 4/1982 | Hilfiker et al. | 405/284 |
| 4,572,711 | 2/1986 | Benson et al. | 405/286 |
| 4,684,287 | 8/1987 | Wojciechowski | 404/6 |

FOREIGN PATENT DOCUMENTS

| | | | |
|---|---|---|---|
| 134434 | 6/1986 | Japan | 405/286 |

*Primary Examiner*—Randolph A. Reese
*Assistant Examiner*—John Ricci
*Attorney, Agent, or Firm*—Neil F. Markva

[57] ABSTRACT

A gravity retaining system for a stabilized steep slope comprises a plurality of free standing facing elements disposed end-to-end with respect to each other to form a continuous line of facing elements. Each facing element includes a weight bearing base surface, a front facing surface, a rear soil contacting surface, a top surface and two outwardly directed end surfaces. The weight-bearing base surface includes a stable erection platform sufficient to provide upright free standing stability of each element when backfilling soil against an inwardly tapered portion of the rear surface. An overturning moment about the lower front outer edge of the front facing surface exists when the element is in a free standing upright position and is backfilled from the lower rear outer edge to a preselected height on the rear surface. The weight of each facing element is sufficient to produce a resistance to overturn the facing element about the lower front outer edge that is greater than the overturning moment. A rearwardly extending reinforcing perforate sheet structure is fastened at a horizontal location laterally displaced outwardly from the rear surface along a continuous, elongated coupling line extending in a direction along the rear surface of each facing element and substantially parallel to the lower outer edge of the rear surface of each facing element.

20 Claims, 9 Drawing Sheets

Fig. 3
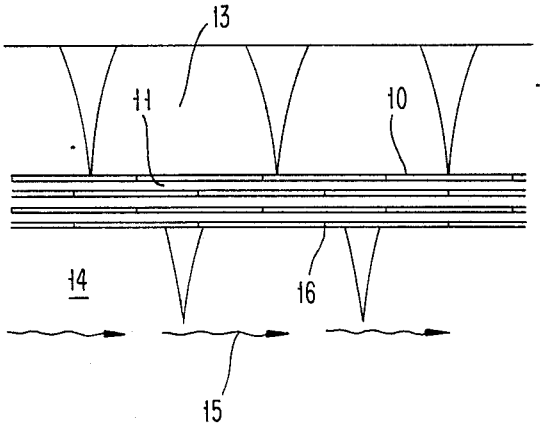
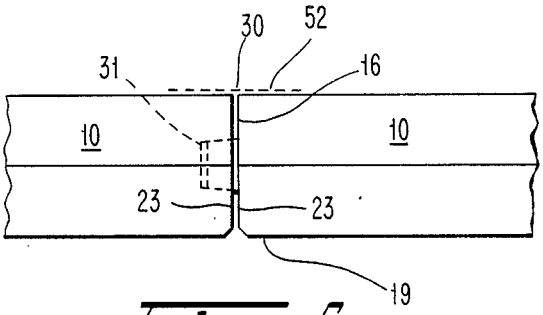
Fig. 6
Fig. 4
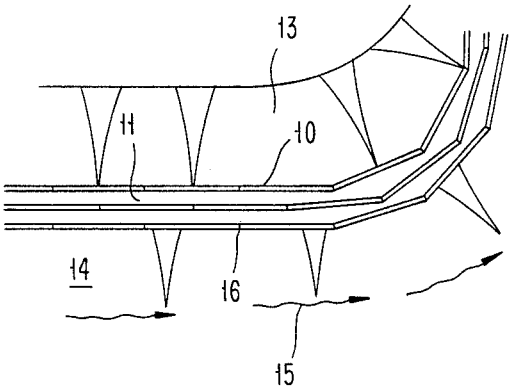
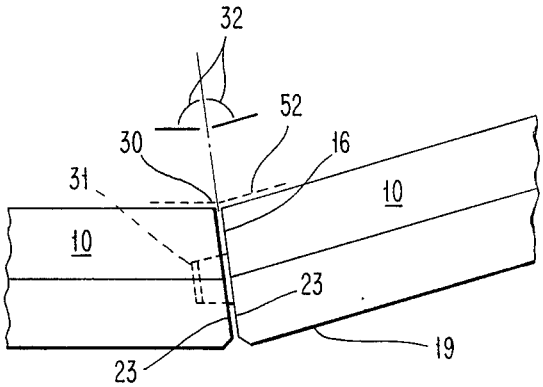
Fig. 7
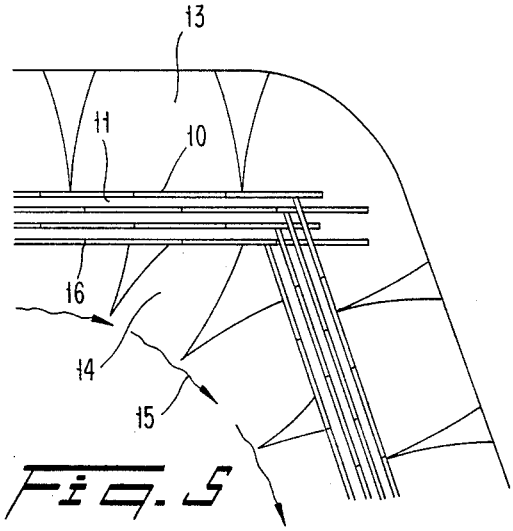
Fig. 5
Fig. 8
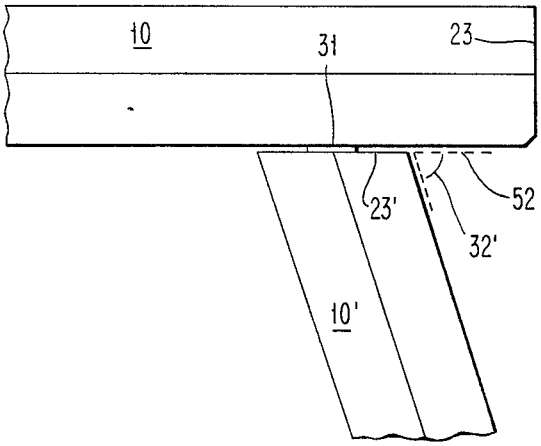

EARTH RETAINING SYSTEM

FIELD OF THE INVENTION

This invention relates to a geofacing earth retaining structure. More particularly, the invention relates to a gravity earth retaining system for a stabilized steep slope where reinforcing elements are used to retain the slope soil.

BACKGROUND OF THE INVENTION

The use of precast concrete facing elements to cover the exposed face of a composite gravity retaining structure is known. Such known composite structure comprises layers of particulate backfill material which alternate with layers of reinforcing members attached to facing elements. The primary binding force is the frictional interaction between the particulate material and the strips of reinforcing elements. U.S. Pat. Nos. 3,421,326 and 4,557,634 typify this known earth stabilization technique. U.S. Pat. No. '634 includes facing elements having frontally projecting buttresses and inwardly inclined facing surfaces to provide an exposed horizontal planting bed for each row of panels and is specifically distinguished over an earth stabilization structure having an essentially continuous concrete face as vertical walls and as in the present invention.

U.S. Pat. No. 4,449,857 discloses a vertically disposed retaining structure having a welded wire grid system providing small frictional forces along the wires of the grid perpendicular to the face and mechanical anchorage along the wires parallel to the face. In this prior art system, a required cast-in-place concrete footing forms a levelling pad without any potential for accommodating a variety of landscaping vegetation to mask the front of the panel. The total weight of each individual facing element is necessarily additive. Thus, the resultant foundational load will tend to overload the bearing capacity of the soil at the front toe of the structure defined at the lower front edge of the vertical retaining wall. Construction of the U.S. Pat. No. '857 vertical retaining wall requires external bracing structures so that the stacked facing elements will remain standing until tie-back wire anchors are applied and backfilled soil is disposed behind the vertical wall.

Further vertically disposed retaining wall structures are disclosed in U.S. Pat. Nos. 4,068,482; 4,343,572; 4,616,959; and 4,662,794. U.S. Pat. No. '482 discloses the use of anchoring elements or vertical tie rods used in combination with other laterally disposed anchoring means. U.S. Pat. No. '572 is a poured-in-place structure with the end of a wire grid system cast-in-place for subsequent attachment of a flexible wire grid. Each of the U.S. Pat. Nos. '959 and '794 discloses vertically disposed facing elements in combination with mats or sheets of preformed perforate mats extending therebehind. Such vertically disposed walls preclude vegetative growth and produce significant foundation loads requiring a poured-in-place base structure.

U.S. Pat. Nos. 2,210,218; 4,050,254; and 4,572,711 disclose facing elements disposed at an angled slope incline and dependent upon a frictional force between a horizontally extending leg and the backfilled soil behind the facing elements to function as a retaining structure. While these modular structures rely upon gravity, the related system operates at limited heights because of the weak resistance to forward sliding within the backfilled soil. Tie-back elements are precast and must extend rearwardly for a significant distance to develop the frictional force required to avoid sliding of the wall in a forward direction under the influence of the pressure caused by the backfilled soil mass. U.S. Pat. No. '218 is very unstable in heights greater than one foot because no provision is made to resist the horizontal earth pressure behind the back of the wall.

U.S. Pat. Nos. 2,880,588 and 3,254,490 disclose sloped retaining wall structures requiring large cast-in-place concrete footings. Furthermore, upright columns are used in combination with the horizontal facing elements. Thus, these systems are not gravity earth retaining systems.

U.S. Pat. Nos. 4,426,176; 4,512,685; 4,671,706; 4,711,606; and 4,459,858 are gravity retaining wall structures wherein stacked individual facing elements produce a relatively large mass to retain an earth mass behind them. The stability of these known structures is related directly to the mass of the structure compared to the height of the backfill. Thus, usefulness of these prior art designs is limited by the large mass required at taller wall heights, i.e., the structural mass required to safely retain the earth becomes so great, economical wall construction is not possible because of the multiplicity or size of the modular units at the bottom thereof. U.S. Pat. Nos. '176, '685 and '606 show various types of anchorage systems to establish large footings or simply gain mass for supporting the large additive vertical loads of individual facing elements piled one on top of the other. The webbed anchor of U.S. Pat. No. '706 does little to stabilize the backfilled earth or prevent overturning of the wall facing if a failure were to occur. U.S. Pat. No. '858 discloses a precast concrete chain forming a dead-man anchor assembly providing no assurance of preventing wall movement in the horizontal direction due to earth pressure behind the wall.

PURPOSE OF THE INVENTION

The primary object of the invention is to produce a gravity retaining system for a stabilized steep slope to accommodate a variety of landscaping vegetation and to limit the transfer of vertical loads from an upper horizontal row of facing elements to the foundational soil.

Another object of the invention is to provide a gravity retaining system for a stabilized steep slope having an incline in the range of 40° to 80°.

Another object of the invention is to provide an earth retaining system comprising a combination of modular facing panels or elements with reinforcing tie-back elements used to reinforce slope soils backfilled against rear soil contacting surfaces of the modular facing elements.

Still another object of the invention is to provide an earth retaining system comprising modular facing elements fastened to rearwardly extending reinforcing perforate sheet structures which maximize both frictional force and mechanical anchorage and are substantially independent of the nature of the soils being stabilized.

A still further object of the invention is to provide an earth retaining system having a continuous line of juxtaposed facing elements disposed end-to-end without relative movement therebetween during a backfilling operation.

A still further object of the invention is to provide a gravity retaining system for a stabilized steep slope having a plurality of free standing facing elements having upright, free standing stability when backfilling soil against the rear surface of each element.

Another object of the invention is to provide an earth retaining system comprising a construction effective to distribute all downwardly directed vertical loads at a preselected total foundation load along the facing which remains substantially constant when backfilled facing elements are rearwardly and upwardly offset with respect to each other along a stabilized steep slope.

A still further object of the invention is to provide a gravity retaining system for a stabilized steep slope which does not require supporting buttresses or large foundational footings while surcharge pressures created by upper facing units are limited.

Still another object of the invention is to provide a gravity retaining system using known geogrid reinforcing elements in combination with unique facing elements having a stable upright, free standing capacity while eliminating any need for structural reinforcement or poured-in-place footings.

Another object of the invention is to provide a gravity retaining structure for a stabilized steep slope wherein the total foundation load at the toe of the structure is at a limiting bearing pressure in the range from about 500 to about 1000 pounds per square foot.

A still further object of the invention is to provide a prefabricated facing panel for use in a soil retaining system and comprising a structural configuration sufficient to support the facing panel in a stable upright, free standing position when backfilling soil against its rear surface.

Another object of the invention is to provide a prefabricated soil retaining facing element having a weight of an amount sufficient to produce a resistance to overturn the facing element about its lower front outer edge.

A still further object of this invention is to provide a gravity retaining system for a stabilized steep slope including reinforced precast concrete connected to a perforate polymeric sheet material to produce a low cost, effective earth retaining structure that is aesthetically pleasing and durable.

Still another object of the invention is to provide a earth retaining system which limits (1) relative movement between juxtaposed precast facing panels and (2) vertical load transfer to the foundational soil along the facing while gaining the benefit of using perforate polymeric sheets extending rearwardly from the rear soil contacting surface of each facing panel.

SUMMARY OF THE INVENTION

The invention as described herein is directed to a gravity retaining system for a stabilized steep slope comprising a plurality of free standing juxtaposed facing elements disposed end-to-end to form a continuous line of facing elements. The line of elements defines a continuous wall structure having a front exposed face for the stabilized steep slope and a rear soil contacting face. Each facing element includes a weight bearing base surface, a front facing surface, a rear soil contacting surface, a top surface and two outwardly directed end surfaces. At least a portion of the rear surface is tapered inwardly with respect to the front surface at a back angle between the base surface and the inwardly tapered rear surface portion.

The weight-bearing base surface of each facing panel includes a stable erection platform sufficient to provide upright free standing stability to each element when backfilling soil against the inwardly tapered portion. Connecting means fasten a rearwardly extending reinforcing perforate sheet at a horizontal location laterally displaced outwardly from the rear surface. The connecting means includes a continuous, elongated coupling line extending in a direction along the rear surface of each facing element and substantially parallel to a lower outer edge of the rear surface of each facing element. The coupling line extends continuously along at least 80% of the total length of each facing element. The connecting means has a fastening strength substantially equal to the allowable tensile strength of the reinforcing sheet.

The stable erection platform is effective to distribute all downwardly directed vertical loads at a preselected total foundation load which remains substantially constant when backfilled facing elements are rearwardly and upwardly offset with respect to each other along a stabilized steep slope. Each end surface of the panels includes load transfer means for precluding relative movement between two facing end surfaces of juxtaposed elements disposed end-to-end with respect to each other.

A particular feature of the invention is directed to the load transfer means including keyway means on one of the juxtaposed end surfaces and matching male means on the other of said juxtaposed surfaces registered with the keyway means. The load transfer means has a strength sufficient to maintain the juxtaposed relationship of the two facing end surfaces if voids were formed in the earth under the facing elements due to localized settlement.

Another feature of the invention is directed to facing elements composed of steel reinforced precast concrete including keyway means and matching male means integrally formed in the concrete. The keyway and matching male means fit into each other for precluding relative movement between the end-to-end surfaces of juxtaposed facing panels.

Another feature of the invention is directed to the structure of each facing element wherein each of the front and rear surfaces have four front outer edges and four rear outer edges, respectively. The top and base surfaces each have front and rear outer edges defining upper and lower of the respective front outer edges and rear outer edges of the front and rear surfaces. Each of the outwardly directed end surfaces have a front and rear outer edge and an upper and lower outer edge. The front and rear edges of the end surfaces define opposing respective front outer and rear outer edges of the front and rear surfaces. The upper and lower edges of the end surfaces define opposing respective upper and lower outer edges of the top and base surfaces.

The lower front outer edge extends substantially continuously along the entire length of the facing element. The front facing surface is at a lower front angle of no more than 90° with respect to the base surface. The height of the facing panel is about 2.5 to about 3.0 feet and the width of the base surface measured from the front lower edge to the rear lower edge is about 9 to about 12 inches. The sloping rear surface portion tapers at a back angle of about 81° with respect to the base surface.

Another feature of the invention is a facing element composed of precast material with connecting means comprising of a section of reinforcing perforate sheet embedded in the precast material. A front angle between the front facing surface and the base surface is not more than 90°. A back angle between the sloping rear surface portion and the base surface is less than 90° and greater than 75°. The facing element height is sufficient to allow the disposition of at least two layers of soil backfilled upwardly along the rear soil contacting surface wherein the layers have a thickness to meet selected compaction requirements for the soil. The back angle is sufficient to eliminate any downwardly directed additive load effect when backfilled facing elements are rearwardly and upwardly offset with respect to each other along a stabilized steep slope.

Another feature of the invention is directed to the use of facing elements that are rearwardly and upwardly offset with respect to each other and produce a surcharge load downwardly within the gravity retaining system of the invention. The surcharge load produces a resultant downward loading effect upon the next below rear soil contacting surface of each facing element. Connecting means is disposed at a vertical location intermediate the base and top surfaces of each facing element where the resultant downward loading effect is substantially greatest.

The rear surfaces of each facing element includes an upper abutment portion adjacent the top surface and the front surfaces thereof each includes a lower abutment portion adjacent the base surface. Bearing block means is substantially contiguously disposed between an upper abutment portion of a lower continuous line of facing elements and a lower abutment portion in the next adjacent rearwardly disposed continuous line of facing elements. The bearing block means is effective to determine a slope incline of the retaining system at an overall layback angle between the horizontal and a line extending upwardly and intersecting the front outer edges of the facing element top surfaces rearwardly offset in the gravity retaining system. The layback angle is in the range from about 40° to about 80°.

BRIEF DESCRIPTION OF THE DRAWINGS

Other objects of this invention will appear in the following description and appended claims, reference being made to the accompanying drawings forming a part of the specification wherein like reference characters designate corresponding parts in the several views.

FIGS. 3, 4 and 5 are top plan views of respective tangent, curved and angled earth retaining system structures diagrammatically showing slopes and a stream with respect to the retaining structure;

FIGS. 6, 7 and 8 are detailed plan views of the longitudinal joints between facing panels used in the respective retaining system structures shown in FIGS. 3, 4 and 5;

FIG. 18 is a fragmentary cross-sectional enlarged view of a gravity retaining system of FIG. 17;

FIG. 22 is a sectional view of another embodiment of a facing element for use in a gravity retaining system according to the invention;

FIG. 23 is a fragmentary rear elevational view of a connecting system for a perforate reinforcing sheet structure according to the invention;

FIG. 24 is an end elevational view of the connecting system of FIG. 23;

FIG. 25 is a top plan view of the system of FIG. 23.

DETAILED DESCRIPTION OF INVENTION

Figure 1:
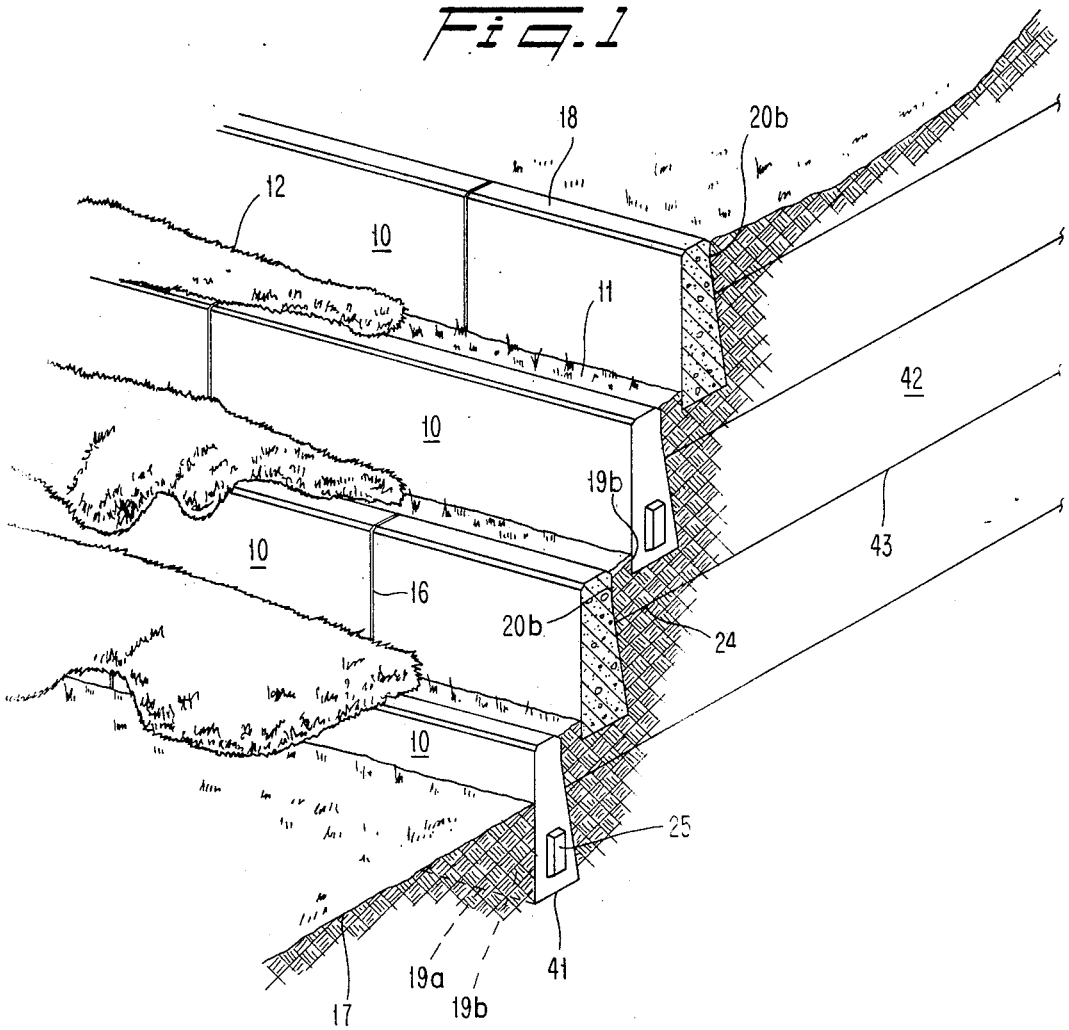
FIG. 1 is a perspective view of a gravity earth retaining system made in accordance with the invention.

The gravity earth retaining system as shown in FIG. 1 is designed to overcome slope stability failure where the weight of the slope exceeds the resisting force produced by the friction of the soil. This compares differently to the evaluation of a retaining wall system having a vertical face evaluated in completely different known methods. It is known that any soil has a certain columnar capacity under which that soil will bear up. Thus, if there is a vertical wall system, the weight at the bottom of that wall must be dissipated on a poured in-place foundation. The gravity retaining system as shown in FIG. 1 eliminates the necessity for such a foundational structure because of the specific design of each facing element 10 and the manner in which such facing elements are placed along the slope.

The gravity retaining system of FIG. 1 is designed for a stabilized steep slope system wherein a slope may be located below the bottommost line of facing elements 10 and a slope above the uppermost line of facing elements 10. Generally speaking, the slope retaining system of the invention is very useful in situations where the slopes exceed a 1:1 ratio or in the range of slope incline from about 40° to 80° and, more particularly, in the range of slope incline from about 45° to 75°.

Facing elements 10 are rearwardly and upwardly offset with respect to each other as shown with vegetation 12 growing within level planting areas 11. The vegetative cover 12 may consist of ivy or any other shallow root perennial plants. Vertical joint 16 between facing elements 10 are generally staggered from one row to the next as shown.

Backfilled soil 42 behind the retaining wall contains perforate reinforcing sheet elements 43 such as a commercially available geogrid structure extending rearwardly from each facing element 10. Grade adjustments are made at the bottom of the gravity system to maintain a minimum embedment below the ground elevation 17 as shown in FIG. 1 and, more particularly, in the front elevational view of FIG. 2.

As shown in FIG. 1, backfilled soil 42 is disposed behind the vertically and rearwardly offset continuous rows of facing elements 10 each having a sloped portion thereof. Soil 42 produces pressure forces directed to the back sloped surface portion of each panel 10. The weight of each panel 10 produces a vertical downwardly directed load within soil 42 which load is directed, in part, as a surcharge load to the next lower continuous line of facing elements 10 in the gravity retaining system as shown in FIG. 1.

The earth retaining system of the present invention has a foundational load with a limited bearing pressure at the bottom row of facing panels or elements 10, i.e., according to the invention the foundational load remains at a substantially preselected constant regardless of how many rows of elements 10 are offset rearwardly and upwardly therebehind. Due to the particular design and disposition of facing elements 10 along the slope as shown in FIG. 1, the selected total foundation load is maintained at a limiting bearing pressure in the range of from about 500 to about 1,000 pounds per square foot.

Figure 2:
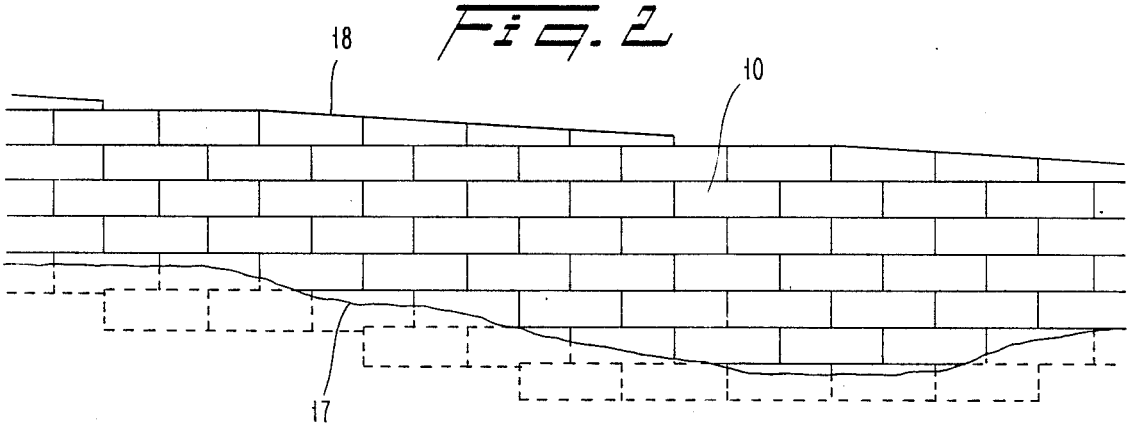
FIG. 2 is a front elevational view of a retaining system as shown in FIG. 1.

The stabilized steep slope of FIG. 1 has an overall layback angle in the range from about 40° to about 80° and, more particularly, from about 45° to about 70°. The particular structure of facing elements 10, gives great flexibility in developing the height, length, plan layout, and incline of the stabilized steep slope of FIG. 1. Further as shown in FIG. 2, top surface 18 of the wall shows grade adjustment by simply truncating the top surfaces of individual panels 10 while pouring concrete during the fabrication of those panels.

Variations in plan layout for the retaining system are detailed in FIGS. 3, 4 and 5 with the vertical joints 16 to be handled in the specific manner as shown in respective FIGS. 6, 7 and 8. The layouts shown in FIGS. 3, 4 and 5 show a stream indicated by arrows 15 in each instance at the bottom of a slope having an upper slope portion 13 and lower slope portion 14 separated by the gravity earth retaining system for a stabilized steep slope made in accordance with the invention.

The plan layout of FIG. 3 uses panel joint 16 of FIG. 6 having surfaces 23 cast square to front facing surfaces 19 with a constant spacing 30 being maintained between each panel 10. An expansion joint material or template 31 may be used during construction of the earth retaining wall to maintain the constant spacing 30 between juxtaposed end surfaces of adjacent panels 10. Filtering fabric 52 placed behind each open joint 16 keeps space 30 relatively free of soil.

Joint 16 of FIG. 7 used in the layout of FIG. 4 includes facing element ends 23 formed in the casting at incremental angles 32 with respect to front facing surfaces panel 19. Thus, panels 10 may be placed as short chords around the perimeter of an arc created by a curve as shown in FIG. 4. Again, filtering fabric 52 is placed behind each open vertical joint 16 juxtaposed adjacent end surfaces of facing elements 10. The adjacent end surfaces are square with respect to each other as shown.

The layout of FIG. 5 shows the ends of a plurality of continuous lines abutting the front faces of panels 10 on adjacent slopes at an angle. Here various lengths of panels 10′ have their end faces cast to intersect end panel 10 while maintaining the standard joint 16 of horizontal rows as shown in FIG. 5. Panel ends 23′ are cast at various angles 32′ with filtering fabric 52 being placed behind the open abutment as shown. Again, expansion joint material 31 maintains the appropriate spacing between adjacent panels 10 and 10′.

The earth retaining system as shown in FIGS. 1–8 provides a limiting bearing pressure at the toe of the structure due to the total foundation load along the facing. If the weight of the earth above the foundation soil exceeds 1000 pounds per square foot this weight must go into the soil below. The limiting bearing pressure effect is applicable when the height of earth above the foundation level does not exceed 8′±. Therefore, the non-additive loading is only in the area of the facing elements where the entire system includes not only the facing elements, but also the geogrid reinforced zone behind the facing elements. This is very significant because the critical bearing pressure is at the toe where the loading can be controlled as discussed below.

Figure 17:
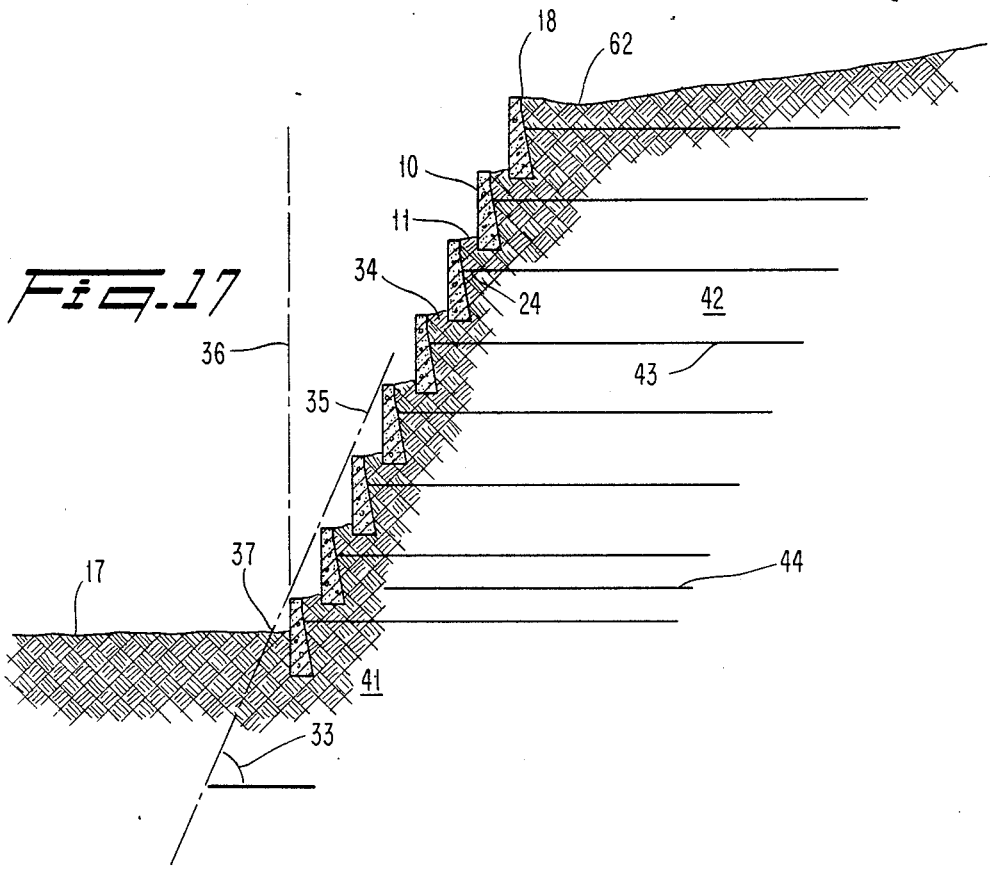
FIG. 17 is a cross sectional view of a gravity retaining system according to the invention.

Various modifications of the overall gravity earth retaining system of the invention are shown in FIGS. 17–21. The incline or layback angle 33 as shown in FIG. 17 may be varied by changing the laterally spaced distance along the horizontal between the offset and rearwardly spaced lines of panels 10. Furthermore, layback angle 33 is also a function of the height of facing panels 10 and the depth to which the rearwardly spaced panels are embedded below the next preceding line of elements 10.

Referring to FIG. 17, the ability to change layback angle 33 permits use of the retaining system in areas where foundation soils are weak and therefore, vertical wall systems cannot be used. By comparison, vertical wall systems would create a potential for bearing capacity failure along the lower front edge or front toe of the wall. By eliminating the wedge of soil between the inclined face 35 and a vertical wall face 36, significant loads are removed from the foundation soils at the critical toe area 37 located at the grade change. By increasing the inclined layback angle 33 significant loads contributing to slope failure are removed from soil 42. Furthermore, soil reinforcing elements 43 may be lengthened to intercept the surface of failure to preclude deep seated failures as discussed above.

No surface conflicts exist with soil reinforcing perforate mat or reinforcing element 43 in the embodiment of FIGS. 17 and 18. That is, top surface 62 does not intersect mat 43 connected to the top line of elements 10 as shown. Panels 10 are disposed on level compacted subgrade within foundation soils 41 or retained soils 42. Reinforcing elements 43 are installed as facing panels or elements 10 are backfilled. Additional reinforcing elements 44 can be placed within the reinforced soil mass if design conditions require. However, these additional elements 44 generally need not be connected to the facing element 10.

The top of the system includes a diversion ditch 62 thereby preventing surface water run-off from spilling over the front of the top line of panels 10. An open joint between each panel 10 avoids water pressure buildup behind the wall. Thus, water may leak through such an open joint and in extreme cases bleed over the top of individual panels 10. A filtering fabric 45 placed over the open joint between panels 10 along the rear surface 20 minimizes the loss of fines in the retained soil 42.

A soil erosion matting 46 placed below the open planting area 11 eliminates undermining of the line of panels 10 disposed upwardly and rearwardly behind the next adjacent lower line of panels as shown. Vegetative cover 12 in planting area 11 greatly increases the stability of the shallow top soil between abutting portions 19b and 20b of panels 10 in adjacent lines of offset panels.

Figure 9:
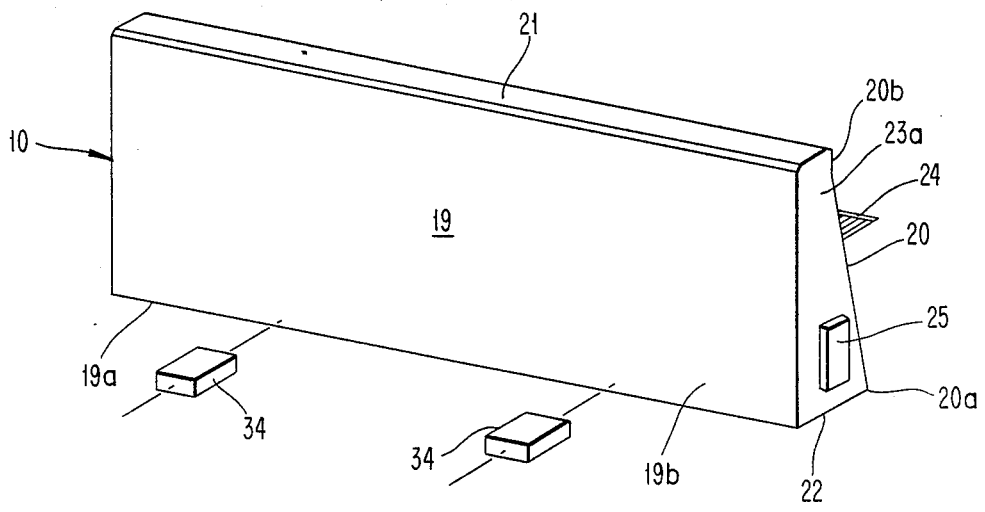
FIG. 9 is a perspective view of a facing element for use with a gravity retaining system according to the invention.

Bearing blocks 34 shown in FIG. 9 are placed within planting area 11 at substantially equal distances laterally displaced with respect to each other. The laterally displaced locations are between the staggered joints of juxtaposed panels 10 in each continuous line of panels. Thus, bearing blocks 34 may be placed at the quarter points closest to the ends of panels 10 as generally shown in FIG. 9.

Figure 19:
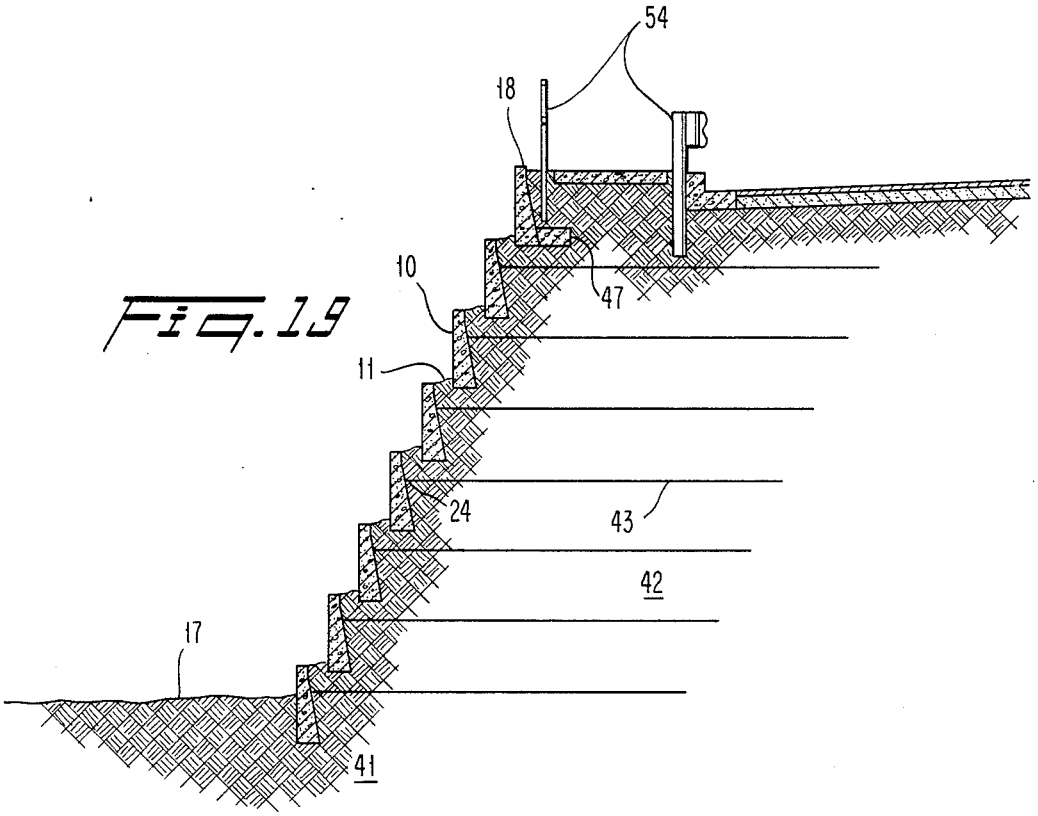
FIG. 19 is a cross sectional view of a further embodiment of a gravity retaining system according to the invention.
Figure 1B:
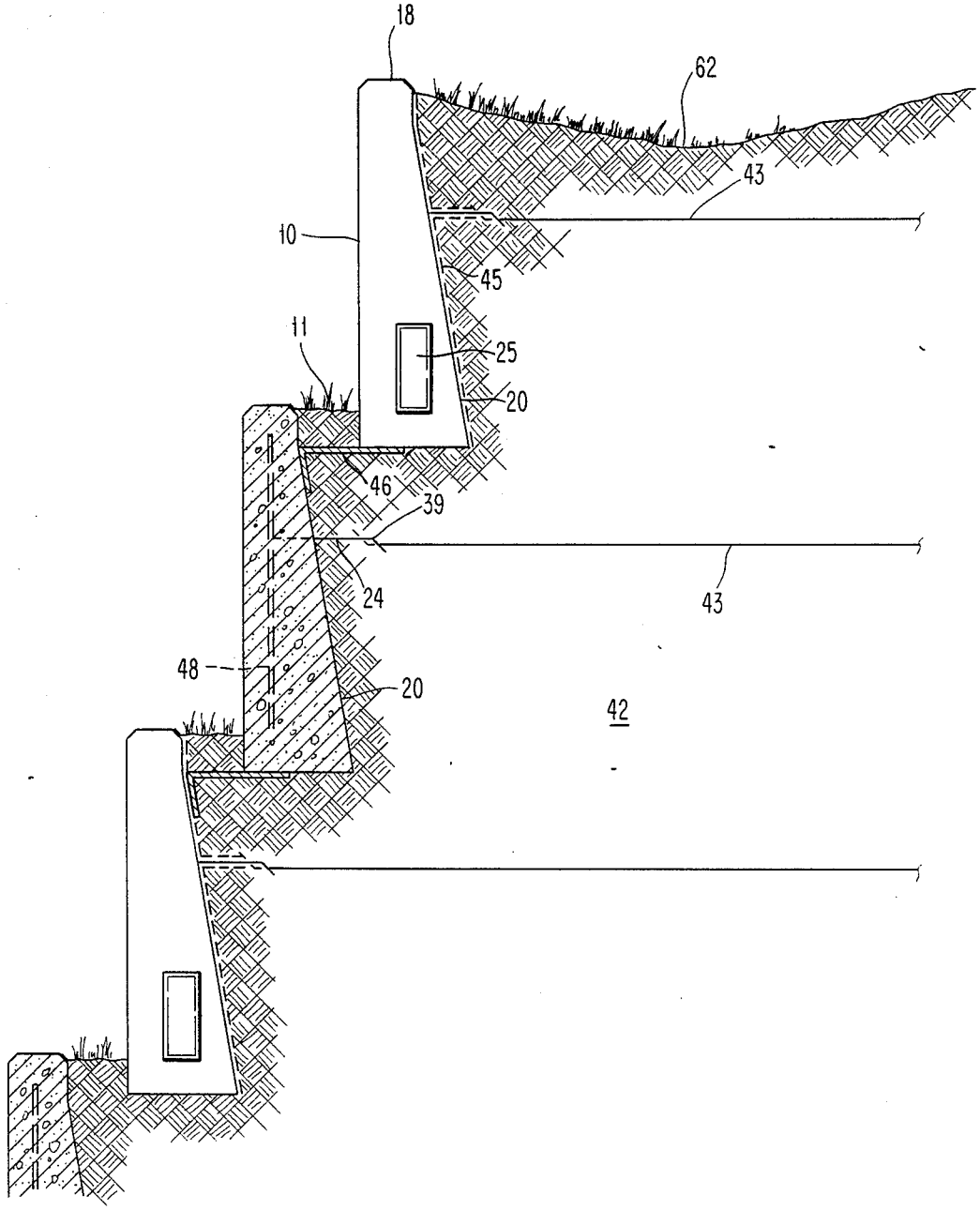
Figure 20:
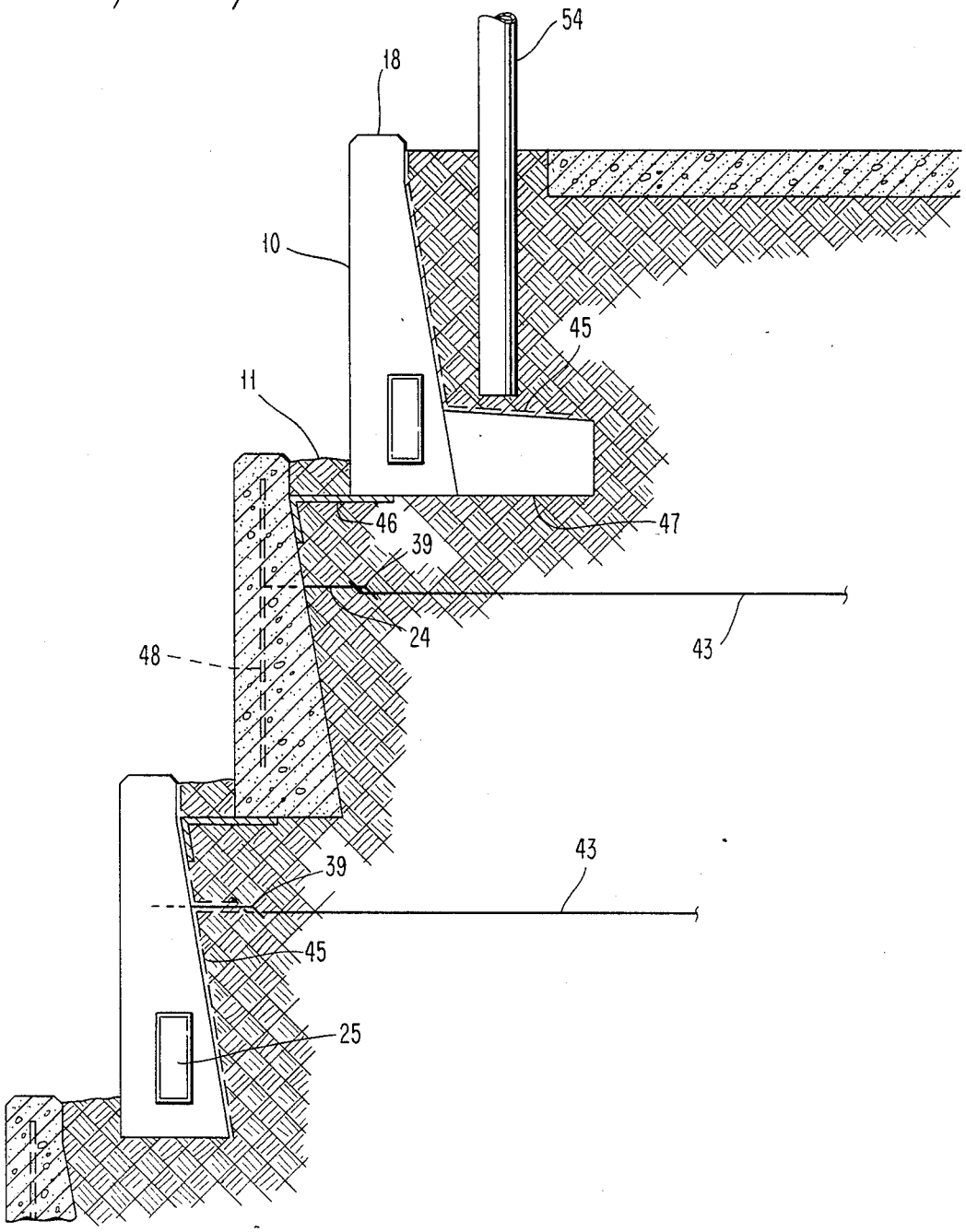
FIG. 20 is a fragmentary cross-sectional enlarged view of the gravity retaining system of FIG. 19.

The embodiment of the gravity earth retaining system as shown in FIGS. 19 and 20 displays a shallow surface conflict between pole 54 and the placement of a rearwardly extending mat 43 from the top line of panels 10. In this embodiment, a top layer of soil reinforcing element 43 is eliminated and a cast-in-place concrete extension 47 secures the top line of panels 10 and keeps facing panels from turning about the lower front edge 19a when soil 42 is retained at a level above the normal location of reinforcing element 43.

In each of the embodiments shown in FIGS. 17 and 19, the perforate reinforcing sheet 43 is connected to a reinforcing sheet section embedded within the precast structure of each facing panel 10. End connecting section 24 is connected to reinforcing geogrid element 43 using a well known connection system generally referred to in the industry as the Botkin connection 39. Here, the embedded connecting section 24 fits into the end of the reinforcing geogrid element 43 to produce interlocked ends having a rod projecting therethrough.

Figure 21:
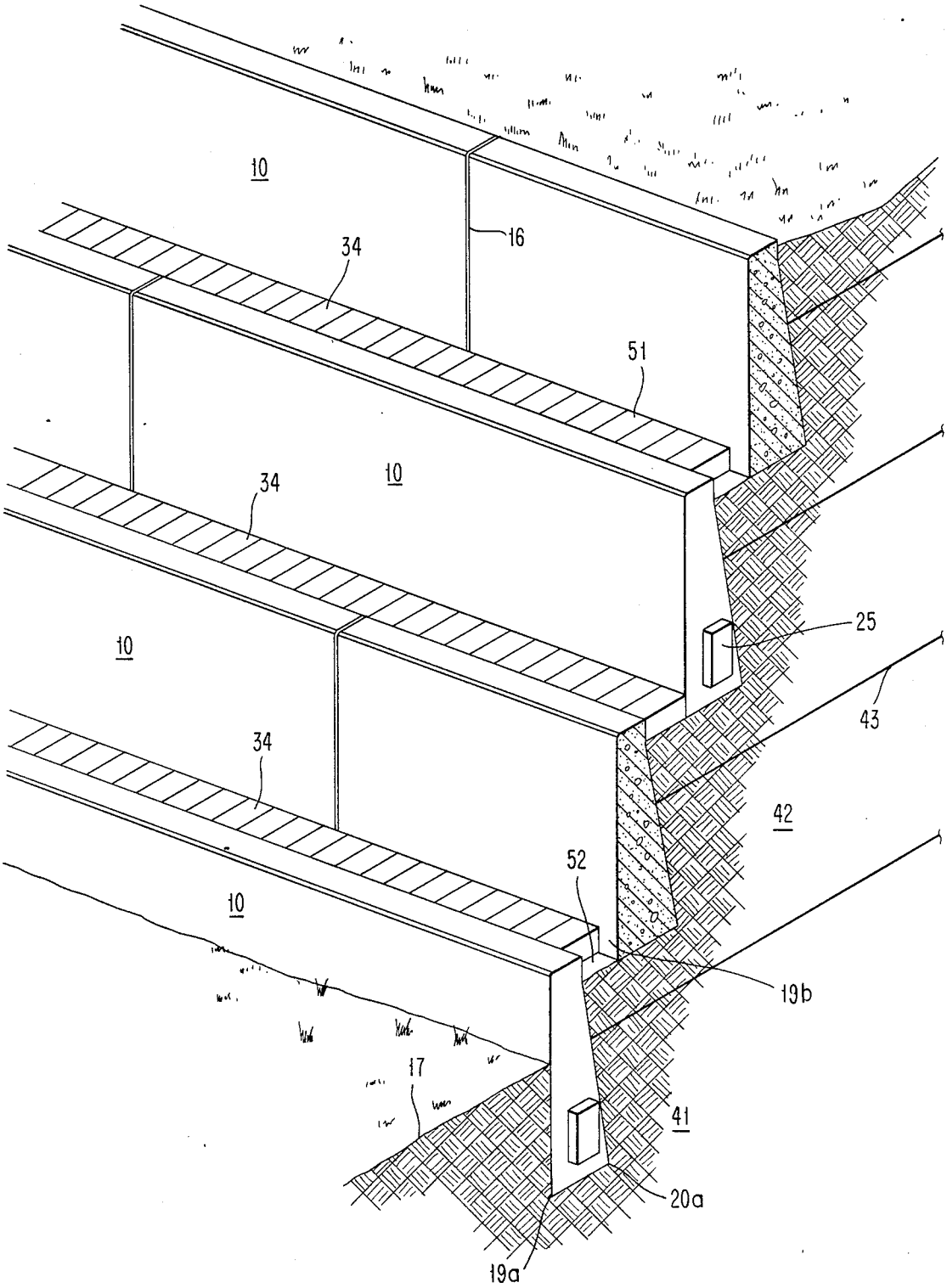
FIG. 21 is a perspective view of another embodiment of a gravity retaining system, partially in section, made in accordance with the invention.

The embodiment shown in FIG. 21 provides a continuous paving surface 51 using a plurality of juxtaposed bearing blocks 34 thereby eliminating a planting area. This embodiment protects the level step from any erosion whatsoever. In a tangent wall layout as in FIG. 3, a standard dimension precast paver may be used to fill the void area. However, in curved layouts such as in FIG. 4, the width of the step will vary such that cast-in-place concrete would be required to fill the opening. In such an embodiment, soil erosion matting 46 would be replaced with filtering fabric 52 as used with the open joints in FIGS. 6, 7 and 8 as discussed above.

The gravity earth retaining system of the invention is necessarily composed of a plurality of facing elements 10 having a unique design for accomplishing the results set forth above related to the structure of the overall system. Structural detail of facing panels 10 is shown in FIGS. 9–16 and FIGS. 22–25. As is evident in the drawings and as disclosed herein, each facing element 10 has a prefabricated unitary structural configuration.

Figure 10:
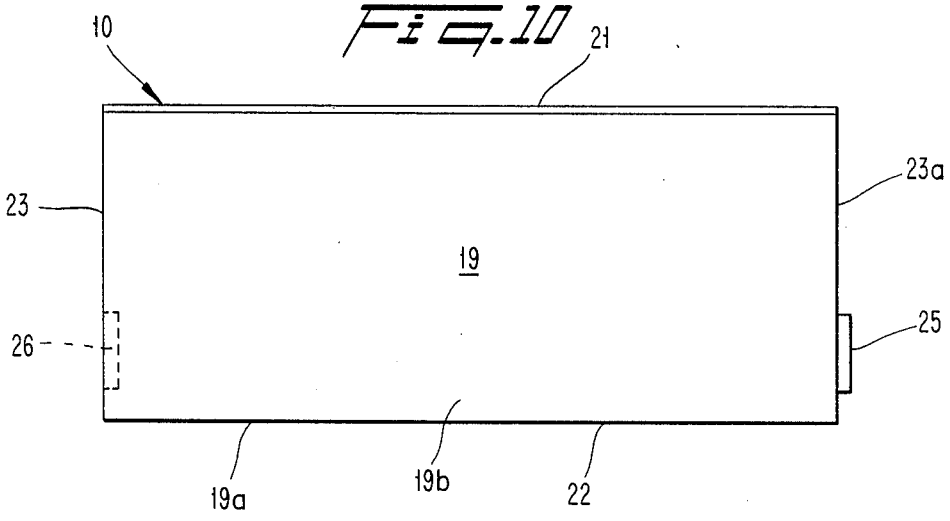
FIG. 10 is a front elevational view of the facing element of FIG. 9.
Figure 11:
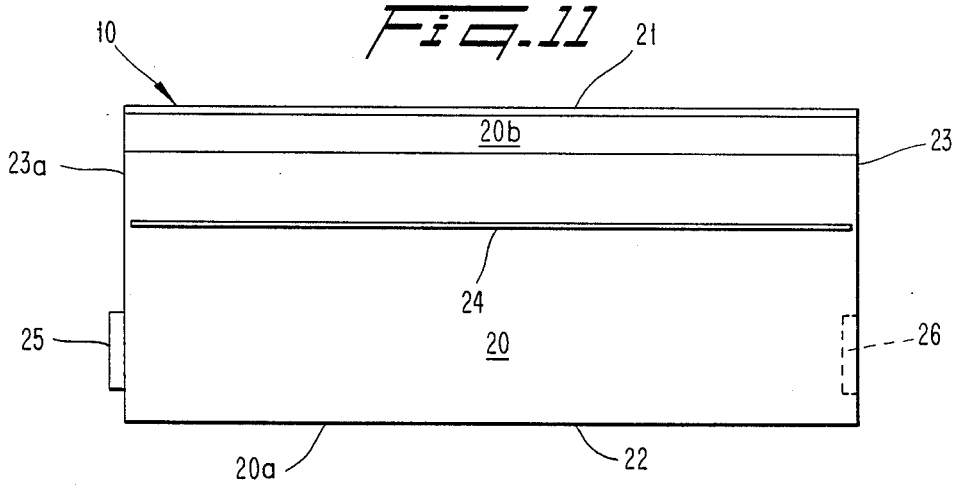
FIG. 11 is a rear elevational view of the facing element of FIG. 9.
Figure 12:
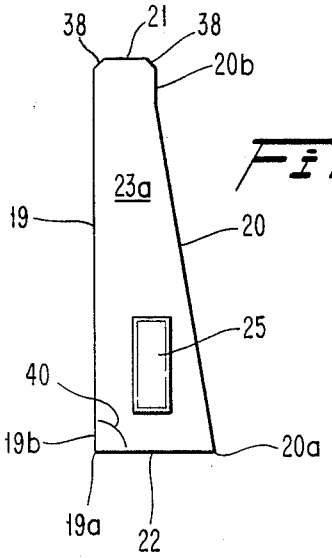
FIG. 12 is an end elevational view of the facing element of FIG. 9.

Referring to FIGS. 9–11, the facing panel or element 10 comprises a weight-bearing base surface 22, a front facing surface 19, a rear soil contacting surface 20, a top surface 21, and two outwardly directed end surfaces 23 and 23a. Each of the front and rear surfaces 19 and 20, respectively, have four front outer edges and four rear outer edges as shown. The top and base surfaces 21 and 22 each have front and rear outer edges defining upper and lower of the respective front outer edges of the front and rear surfaces 19 and 20.

Each of the outwardly directed end surfaces 23 and 23a have a front and rear outer edge and an upper and lower outer edge as shown. The front and rear outer edges of end surfaces 23 and 23a define opposing respective front outer and rear outer edges of front and rear surfaces 19 and 20. The upper and lower edges of end surfaces 23 and 23a define opposing respective upper and lower outer edges of the top and base surfaces 21 and 22.

In a specific embodiment of the invention, the weight of a steel reinforced precast concrete panel 10 is about 212 pounds per lineal foot producing an overall weight of about 1,500 pounds. The height dimensions of the precast steel reinforced concrete panel 10 includes a height of about 2.5 feet, a base of about 9 inches in width measured from the front lower edge 19a to the rear lower edge 20a, the width of top surface 21 measured from the front to the rear being about 4½ inches.

When considering overturning moments about the lower front toe edge 19a, and making some general assumptions for the backfill earth or soil 42, in a generally known manner, an overturning moment of approximately 25 foot-pounds is developed when panel 10 is backfilled to a height of the embedded geogrid end connecting section 24, i.e., about 1.6 feet above front toe edge 19a. With the weight of panel 10 as stated, a resistance to overturn is produced in the amount of about 64 foot-pounds or at a ratio of about 2.5:1. This relationship is important because panel 10 must be backfilled to the elevation of the geogrid reinforcing element 43 while in a stable upright and free standing position.

Thus, weight-bearing surface 22 includes a stable erection platform sufficient to produce facing element 10 in a stable upright, free standing position when backfilled soil 42 contacts the rear sloping portion of rear surface 20 that tapers upwardly from base surface 22 and inwardly toward front facing surface 19.

The lower front outer edge 19a extends substantially continuously along the entire length of facing element 10. Front facing surface 19 is disposed at a lower front angle of no more than 90° with respect to base surface 22 and may be tapered slightly inwardly. Various architectural finishes may be cast into the front facing surface 19 using such things as form liners or striations. All exposed edges may be chamfered in accordance with industry standards.

The panel height of about 2.5 feet is used to produce a 70° overall layback angle 33 of the retaining system as discussed above. A minimum of exposed earth at planting area 11 is about 5.75 inches. While the height may vary, the particular dimension of the specific embodiment maximizes both erection time and compatibility with a variety of overall structural heights thereby standardizing precast dimensions. The 2.5 foot panel height allows the disposition of two layers of earth fill behind the wall at approximately 13 inches per layer which is a practical maximum thickness when meeting standard compaction requirements for backfilled soil 42.

The stable erection platform of base surface 22 permits vertical loads from each panel 10 and the surcharge load from the next above panels 10 in the earth retaining system of the invention to be distributed over the foundation soils 41 and 42 at not more than about 700 pounds per linear foot of facing element 10. The size of the stable erection platform will produce a foundation load at a limited bearing pressure in the range of about 500 to 1,000 pounds per square foot. A foundation load of about 600 or 700 pounds per square foot is generally permissable for all load bearing soils. While the width of the base surface 22 may be increased, a significant increase (over 1 inch in width from the front edge 19a to the lower rear edge 20a) would require an increase in the overall layback angle 33 of the retaining system or an increase in the height of individual facing elements 10.

The size of the back angle between base surface 22 and the sloping portion of rear surface 20 is directly related to the anchoring force in the geogrid perforate reinforcing sheet 43 being used. That is, when using a geogrid mat or sheet with a maximum required anchoring force of about 860 pounds per lineal foot, the back angle results in the transfer of about 25% of the surcharge load into the foundation layer. This limiting factor eliminates the continuous adding of vertical loads on the ultimate foundation soil 41 thereby removing the need of a spread footing to distribute a compounded vertical load.

In a specific embodiment, the prefabricated perforate geogrid reinforcing element 43 has a prefabricated width of about 3 feet 4 inches. Thus, the length of panels 10 is in increments of 3 feet 4 inches to match the width of geogrid element 43. Furthermore, in this embodiment, facing elements 10 are 6 feet 4 inches in length, thereby permitting the installation of two geogrid sheets per facing element or panel 10. Other nominal panel lengths would be 3 feet 4 inches or 10 feet to match the existing width of geogrid reinforcing element 43.

Precast concrete facing elements 10 of this embodiment are produced by standard precasting methods using 2,500 psi concrete. Units are reinforced by deformed steel bars such as the vertical bars shown in phantom in FIG. 22. The top width is about 4½ inches governed by the use of (1) two reinforcing bars of ½ inch diameter each which overlap at the top, (2) 1½ inches of protective concrete cover on rear surface 20, and (3) 2 inches of protective concrete cover on front facing surface 19. The top width may be reduced to about 3.25 inches depending upon the amount of reinforcement and concrete cover requirements used.

End surfaces 23 and **23*a* include load transfer means comprising recess 26 and rectangular projection 25 integrally formed on the precast concrete designed to fit into rectangular recess 26. In the specific embodiment, concrete projection 25 is 3 inches by 7 inches and is sufficient to withstand total failure in one geogrid connecting section 24. Matching of keyway recess 26 with rectangular projection 25 precludes relative movement between juxtaposed facing elements 10 with the strength of the load transfer means being sufficient to bridge any voids which may develop due to localized settlement. The keyway transfer projection 25 and recess 26** are designed to provide sufficient shear resistance to support 50% of the panel weight.

Figure 13:
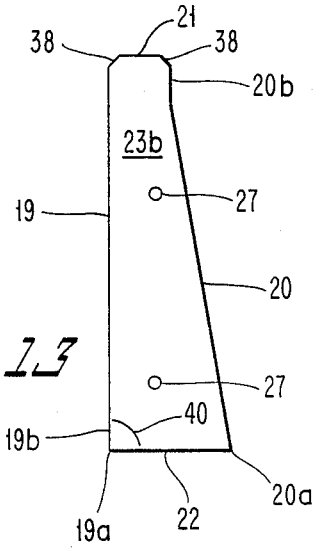
FIG. 13 is an end elevational view of another embodiment of an end surface of a facing element as shown in FIG. 9.
Figure 14:
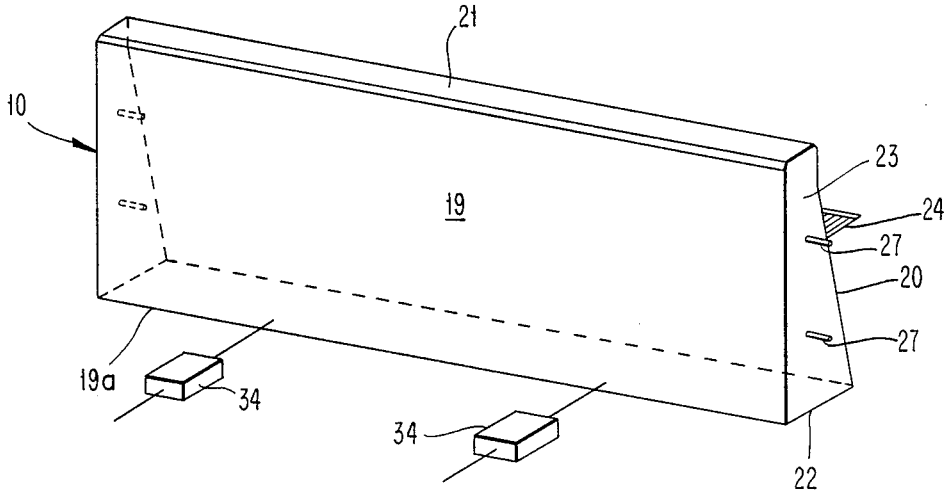
FIG. 14 is a perspective view of another embodiment of a facing element for use in a gravity retaining system according to the invention.

FIG. 13 shows an alternate form of the load transfer mechanism including dowels and sleeves used in place of rectangular projection 25. Non-rusting dowels having a diameter of about one-half inch or greater are installed on one end surface 23 and non-rusting sleeves of compatible size are installed on the other end surface **23*b*. In another embodiment non-rusting sleeves may be placed at both end surfaces 23 and 23*a* with a separate dowel being placed between two facing elements 10**.

As shown in FIG. 11, end connecting section 24 for the perforate reinforcing sheet element 43 is laterally displaced outwardly from rear soil contacting surface 20 and intermediate the top and bottom surfaces 21 and 22. The vertical intermediate location receives the resultant downward loading effect from the surcharge load is substantially greatest from the upwardly and rearwardly disposed facing elements of the gravity retaining system. In this specific embodiment, end connecting section 24 is located within the top 40% of the panel height to restrict movement of the top portion of panel 10 once soil 42 is backfilled over the rearwardly extending perforate geogrid sheet 43.

The intersection of base surface 22 and front facing surface 19 forms a lower front angle of no greater than 90° and may be slightly less than 90°. When less than 90°, panels 10 are installed on a level subgrade with front facing surface 19 being battered back a very small amount.

An abutment portion **20*b* is adjacent to top surface 21 and is parallel to the lower abutment portion 19*b* of front facing surface 19. Bearing blocks 34 are disposed between abutment portions 19*b* and 20*b* in adjacent lines of facing elements 10 as discussed above. The width between lines depends on the particular application of facing elements 10** to a stabilized steep slope structure.

Figure 16:
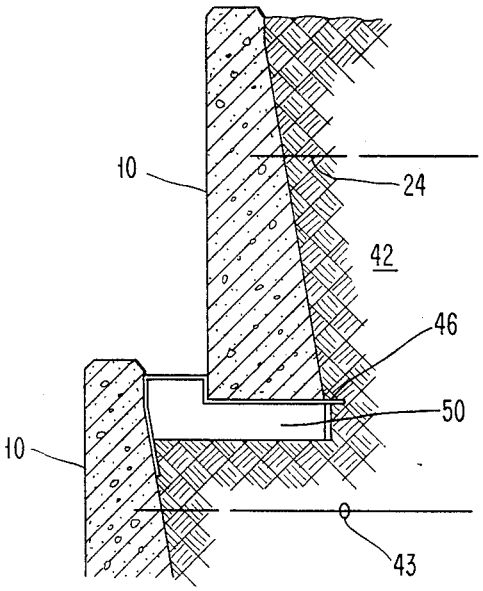
FIG. 16 is a fragmentary cross sectional-view showing the use of the bearing block of FIG. 15 in a retaining system according to the invention.
Figure 15:
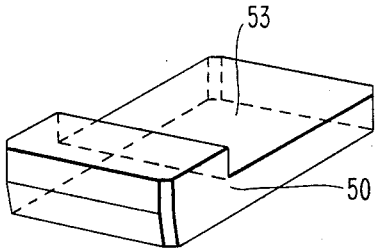
FIG. 15 is a perspective view of another embodiment of a bearing block member according to the invention.

A modified bearing block 50 (FIG. 15) serves as a thrust block as do blocks 34 but also includes an easily leveled bearing pad 53 to facilitate erection of panels 10 as shown in FIG. 16.

End connecting mechanism 24 fastens a rearwardly extending reinforcing perforate sheet structure 43 at a horizontal location laterally displaced outwardly from rear surface 20 along an elongated coupling line extending in a direction substantially parallel to the lower outer edge **20*a* of rear surface 20. The coupling line extends continuously along at least 80% of the total length of facing element or panel 10. In the specific embodiment, connecting means constitutes an embedded section of the reinforcing perforate geogrid structure 43. Connecting section 24 is embedded approximately 11 inches from top surface 21 at a vertical location which offsets the maximum bending or overturning moment in facing element or panel 10 about lower front edge 19*a***. The well known TENSAR geogrid structures specifically designated as the SR series and composed of polymeric plastic matting may be used. The connecting technique is known as the Botkin connection as discussed above.

An alternative method of connecting the reinforcing element is shown in FIGS. 22–25. Hooks 60 are embedded into the precast concrete structure behind a vertical reinforcing rod as shown in FIG. 22. The connecting assembly includes top bar 63 and bottom bar 64 connected together by a ½ inch diameter bolt 65 and lock washers. Elongated slots 66 are spaced for registering with the particular number of hook bolts 60 projecting outwardly from rear surface 20 as shown in FIG. 22.

The end of geogrid structure 43 is placed between bars 63 and 64. Bolt 65 tightens bars 63 and 64 together across the entire width of geogrid structure 43 thereby producing a strong friction hold along a continuous, elongated line across at least 80% of the length of panel 10 along the entire width of geogrid 43.

The geogrid structure length extending outwardly from rear surface 20 depends upon the particular characteristics of the soil being retained.

While the geofacing earth retaining system has been shown and described in detail, it is obvious that this invention is not to be considered as limited to the exact form disclosed, and that changes in detail and construction may be made therein within the scope of the invention without departing from the spirit thereof.

Having thus set forth and disclosed the nature of this invention, what is claimed is:

1. A gravity retaining system for a stabilized steep slope, said system comprising:

(a) a plurality of unitary prefabricated free standing facing elements disposed end-to-end with respect to each other to form a continuous line of facing elements;

(b) said line of facing elements defining a continuous wall structure having a front exposed face for the stabilized steep slope and a rear soil contacting face;

(c) each facing element including a weight-bearing base surface, a front facing surface, a rear soil contacting surface, a top surface and two outwardly directed end surfaces;

(d) at least a portion of the rear surface is tapered inwardly with respect to the front surface at a back angle which is formed between the base surface and the inwardly tapered portion;

(e) the weight-bearing base surface including a stable erection platform sufficient to provide upright, free standing stability of each element when backfilling soil against said inwardly tapered portion;

(f) connecting means fastening a rearwardly extending reinforcing perforate sheet structure at a horizontal location laterally displaced outwardly from the rear surface along a continuous, elongated coupling line extending in a direction along the rear surface of each facing element and substantially parallel to a lower outer edge of the rear surface of each facing element;

(g) said connecting means having a fastening strength substantially equal to the allowable tensile strength of the reinforcing sheet structure;

(h) said stable erection platform being effective to distribute all downwardly directed vertical loads at a preselected total foundation load which remains substantially constant when backfilled facing elements are rearwardly and upwardly offset with respect to each other along a stabilized steep slope.

2. A gravity retaining system as defined in claim 1 wherein each end surface includes load transfer means for precluding relative movement between two facing end surfaces of juxtaposed elements disposed end-to-end with respect to each other.

3. A gravity retaining system as defined in claim 2 wherein the load transfer means includes keyway means on one of the juxtaposed end surfaces and matching male means on the other of said juxtaposed surfaces registered with said keyway means;

said load transfer means having a strength sufficient to maintain the juxtaposed relationship of said two facing end surfaces if voids were formed in the earth under the facing elements due to localized settlement.

4. A gravity retaining system as defined in claim 3 wherein the facing elements are composed of reinforced precast concrete;

the keyway means consists of a rectangular recess integrally formed in said concrete; and the matching male means consists of a rectangular projection integrally formed on said concrete registered to fit into said rectangular recess.

5. A gravity retaining system as defined in claim 4 wherein the height of each facing element is sufficient to form at least two layers of soil backfilled upwardly along the rear soil contacting surface;

said layers having a thickness to meet preselected compaction requirements for said soil.

6. A gravity retaining system as defined in claim 5 wherein the facing elements are composed of reinforced precast concrete;

the height of each facing element is about 2.5 to about 3.0 feet; and there are at least two lines of facing elements whereby the facing elements in said two lines are rearwardly and upwardly offset with respect to each other along a stabilized steep slope having an overall layback angle of about 45° to about 70°.

7. A gravity retaining system as defined in claim 3 wherein the keyway means includes openings formed in the juxtaposed end surfaces to be registered with respect to each other; and the matching male means includes a solid elongate member having two ends whereby each end thereof fits into the registered openings in said juxtaposed end surfaces.

8. A gravity retaining system as defined in claim 1 wherein there are at least two lines of facing elements wherein the facing elements in said two lines are rearwardly and upwardly offset with respect to each other along a stabilized steep slope having an overall layback angle in the range of from about 40° to about 80°.

9. A gravity retaining system as defined in claim 1 wherein facing elements that are rearwardly and upwardly offset with respect to each other produce a surcharge load downwardly within the gravity retaining system;

said surcharge load produces a resultant downward loading effect upon the next below rear soil contacting surface of each facing element in said gravity retaining system; and said connecting means is a disposed at a vertical location intermediate the base and top surfaces where said resultant downward loading effect is substantially greatest.

10. A gravity retaining system for a stabilized steep slope, said element comprising:

(a) a plurality of free standing facing elements disposed end-to-end with respect to each other to form a continuous line of facing elements;

(b) said line of facing elements defining a continuous wall structure having a front exposed face for the stabilized steep slope and a rear soil contacting face;

(c) each facing element including a weight-bearing base surface, a front facing surface, a rear soil contacting surface, a top surface and two outwardly directed end surfaces;

(d) at least a portion of the rear surface is tapered inwardly with respect to the front surface at a back angle which is formed between the base surface and the inwardly tapered portion;

(e) the weight-bearing base surface including a stable erection platform sufficient to provide upright, free standing stability of each element when backfilling soil against said inwardly tapered portion;

(f) connecting means fastening a rearwardly extending reinforcing perforate sheet structure at a horizontal location laterally displaced outward from the rear surface along a continuous, elongated coupling line extending in a direction along the rear surface of each facing element and substantially parallel to a lower outer edge of the rear surface of each facing element;

(g) said connecting means having a fastening strength substantially equal to the allowable tensile strength of the reinforcing sheet structure;

(h) said stable erecting platform being effective to distribute all downwardly directed vertical loads at a preselected total foundation load which remains substantially constant when backfilled facing elements are rearwardly and upwardly offset with respect to each other along a stabilized steep slope;

(i) the rear surface includes an upper abutment portion adjacent the top surface and the front surface includes a lower abutment portion adjacent the base surface; and (j) bearing block means is substantially contiguously disposed between an upper abutment portion of a lower continuous line of facing elements and a lower abutment portion in the next adjacent rearwardly disposed continuous line of facing elements;

(k) said bearing block means is effective to determine a slope incline of the retaining system at an overall layback angle between the horizontal and a line extending upwardly intersecting front outer edges of the facing element top surfaces rearwardly offset in said gravity retaining system; and (l) said layback angle being in the range from about 40 to about 80.

11. A prefabricated unitary facing element for use in a soil retaining system for a stabilized steep slope, said element comprising:

(a) a weight-bearing base surface, a front facing surface, a rear soil containing surface, a top surface and two outwardly directed end surfaces;

(b) each of said front and rear surfaces having four front outer edges and four rear outer edges, respectively;

(c) the top and base surfaces each having front and rear outer edges defining upper and lower of the respective front outer edges and rear outer edges of the front and rear surfaces;

(d) each of said outwardly directed end surfaces having a front and rear outer edge and an upper and lower outer edge;

(e) the front and rear edges of the end surfaces defining opposing respective front outer and rear outer edges of the front and rear surfaces, (f) the upper and lower edges of the end surfaces defining opposing respective upper and lower outer edges of the top and base surfaces;

(g) said weight-bearing base surface being larger than said top surface and including a stable erection platform sufficient to support the facing element in a stable upright free standing position when backfilling soil against the rear surface having a sloping portion that tapers upwardly from the base and inwardly toward the front facing surface;

(h) connecting means for fastening a reinforcing perforate sheet structure along a continuous, elongated coupling line extending in a direction along the rear surface and substantially parallel to the lower outer edge of the rear surface;

(i) each end surface including load transfer means for precluding relative movement between two facing end surfaces of juxtaposed elements disposed end-to-end with respect to each other, (j) said stable erection platform being effective to distribute all downwardly directed vertical loads at a preselected total foundation load which remains substantially constant when backfilled facing elements are rearwardly and upwardly offset with respect to each other along a stabilized steep slope.

12. A facing element as defined in claim 11 wherein the lower front outer edge extends substantially continuously along the entire length of the facing element; and the front facing surface is at a lower front angle of no more than 90° with respect to the base surface.

13. A facing element as defined in claim 11 wherein the preselected total foundation load is at a limiting bearing pressure in the range from about 500 to about 1,000 pounds per square foot when disposed within a gravity retaining system.

14. A facing element as defined in claim 11 wherein the element is composed of reinforced precast concrete and has a height of about 2.5 to about 3.0 feet;

the width of the base surface from the front lower edge to the rear lower edge is about 9 to about 12 inches; and the sloping portion tapers at a back angle of about 80° with respect to the base surface.

15. A prefabricated unitary facing element for use in a soil retaining system for a stabilized steep slope, said element comprising:

(a) a weight-bearing base surface, a front facing surface, a rear soil contacting surface, a top surface and two outwardly directed end surfaces;

(b) the rear surface including an upper abutment portion adjacent the top surface and a sloping portion that tapers inwardly toward the front facing surface and upwardly toward the top surface;

(c) the front surface is longer than its height and has a lower abutment portion adjacent the base surface;

(d) the weight-bearing base surface including a stable erection platform sufficient to provide upright, free standing stability of the element when backfilling soil against said rear surface sloping portion;

(e) said stable erection platform being effective to distribute all downwardly directed vertical loads at a preselected total foundation load which remains substantially constant when backfilled facing elements are rearwardly and upwardly offset with respect to each other along a stabilized steep slope;

(f) connecting means for fastening a reinforcing sheet element at a location laterally displaced outwardly from the rear soil contacting surface;

(g) an overturning moment about the lower front outer edge of the front facing surface exists when said element is in a free standing upright position on the weight-bearing base surface and is backfilled with particulate soil material upwardly from the lower rear outer edge to the height of the connecting means on the rear soil contacting surface;

(h) the weight of the facing element being sufficient to produce a resistance to overturn the facing element about said lower front outer edge that is greater than said overturning moment.

16. A facing element as defined in claim 15 wherein the element is composed of a precast material; and the connecting means is composed of a section of reinforcing sheet element embedded in the precast material and extends across at least 80% of the entire length of the facing element.

17. A facing element as defined in claim 15 wherein a front angle between the front facing surface and the base surface is not more than 90°.

18. A facing element as defined in claim 15 wherein a back angle between the sloping rear surface portion and the base surface is less than 90° and greater than 75°.

19. A facing element as defined in claim 15 wherein the height of the element is sufficient to allow the disposition of at least two layers of soil backfilled upwardly along the rear soil contacting surface wherein the layers have a thickness to meet preselected compaction requirements for the soil.

20. A facing element as defined in claim 15 wherein a back angle between the base surface and the sloping rear surface portion is sufficient to eliminate any downwardly directed additive load effect when backfilled facing elements are rearwardly and upwardly offset with respect to each other along a stabilized steep slope.

* * * * *